US007794259B2

(12) United States Patent
Zhu et al.

(10) Patent No.: US 7,794,259 B2
(45) Date of Patent: Sep. 14, 2010

(54) ELECTRICAL CONNECTOR ASSEMBLY FOR MINIATURIZATION

(75) Inventors: Jian-Kuang Zhu, Kunshan (CN); Xiao-Gao Yang, Kunshan (CN); Guo-Hui Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/421,657

(22) Filed: Apr. 10, 2009

(65) Prior Publication Data

US 2009/0291581 A1 Nov. 26, 2009

(30) Foreign Application Priority Data

May 23, 2008 (CN) ..... 2008 2 0036779 U

(51) Int. Cl.
*H01R 13/62* (2006.01)

(52) U.S. Cl. ..... 439/327; 439/325

(58) Field of Classification Search ..... 439/325, 439/326, 327, 64, 83, 377
See application file for complete search history.

(56) References Cited

U.S. PATENT DOCUMENTS 5,755,585 A 5/1998 Cheng et al.
6,341,971 B1 * 1/2002 Choy et al. ..... 439/326
6,821,144 B2 * 11/2004 Choy ..... 439/541.5
7,338,307 B2 * 3/2008 Zhang et al. ..... 439/326
7,614,899 B2 * 11/2009 Zhu et al. ..... 439/325
2005/0164549 A1 * 7/2005 Lee ..... 439/541.5
2009/0163055 A1 * 6/2009 Zhu ..... 439/83

FOREIGN PATENT DOCUMENTS

CN 201000940 Y 1/2008

* cited by examiner

*Primary Examiner*—Hae Moon Hyeon
(74) *Attorney, Agent, or Firm*—Andrew C. Cheng; Wei Te Chung; Ming Chieh Chang

(57) ABSTRACT

An electrical connector assembly (100) for connecting memory modules (200) to a printed circuit board (PCB) (300), includes a first and second connectors (10, 20) respectively mounted on two opposite surfaces of the PCB. The first and second connectors each defines an insulative housing (11/21) and a plurality of contacts retained in the housing. Each of the housing defines a front face and an inserted slot (13/23) running through the front face along a longitudinal direction. Each of the contacts defines an elastic arm partly projecting into the inserted slot and a soldering leg connecting to the PCB. The housing of the first connector provides a cavity (172) at a bottom portion thereof. A part of the second connector projects beyond the top surface of the PCB, and the soldering legs of the second connector run through the opposite surfaces of the PCB and enter into the cavity.

20 Claims, 6 Drawing Sheets

ELECTRICAL CONNECTOR ASSEMBLY FOR MINIATURIZATION

BACKGROUND OF THE INVENTION

1. Field of the Invention

The present invention relates to an electrical connector assembly, and especially to a card edge connector assembly for miniaturization.

2. Description of the Related Art

U.S. Pat. No. 5,755,585 issued to Cheng et al. on May 26, 1998 discloses an electrical connector assembly comprising a lower connector mounted on a surface of a printed circuit board (PCB) and an upper connector stacked on the lower connector. However, the lower and upper connectors are stacked on a same side of the printed circuit board, and a large room should be prearranged at one side of the printed circuit board to receive the stacked connectors.

Chinese Patent Issued Number 201000940Y discloses another electrical connector assembly comprising a first connector and a second connector. The first and second connectors are separately mounted on two opposite sides of a printed circuit board, which can decrease the room arranged at one side of the printed circuit board. However, the height of the electrical connector assembly is not decrease, and the electrical connector assembly is also not suitable for miniaturization.

Hence, a new design suitable for miniaturization is required.

SUMMARY OF THE INVENTION

Accordingly, an object of the present invention is to provide an electrical connector assembly suitable for miniaturization.

In order to achieve the object set forth, an electrical connector assembly for connecting memory modules to a PCB, includes a first connector mounted on a top surface of the PCB and a second connector mounted on a bottom surface of the PCB. The first and second connector each defines an insulative housing and a plurality of contacts received and retained in the housing. Each of the housing defines a front face and an inserted slot for receiving the memory module running through the front face along a longitudinal direction. Each of the contacts defines an elastic arm partly projecting into the inserted slot and a soldering leg connecting to the PCB. The housing of the first connector defines a raised portion projecting downwards from a bottom face thereof, thereby providing a cavity at a bottom portion of the first connector. A part of the second connector projects beyond the top surface of the PCB, and the soldering legs of the second connector run through the opposite top and bottom surfaces of the PCB and enter into the cavity.

Other objects, advantages and novel features of the invention will become more apparent from the following detailed description of the present embodiment when taken in conjunction with the accompanying drawings.

DETAILED DESCRIPTION OF THE INVENTION

Figure 1:
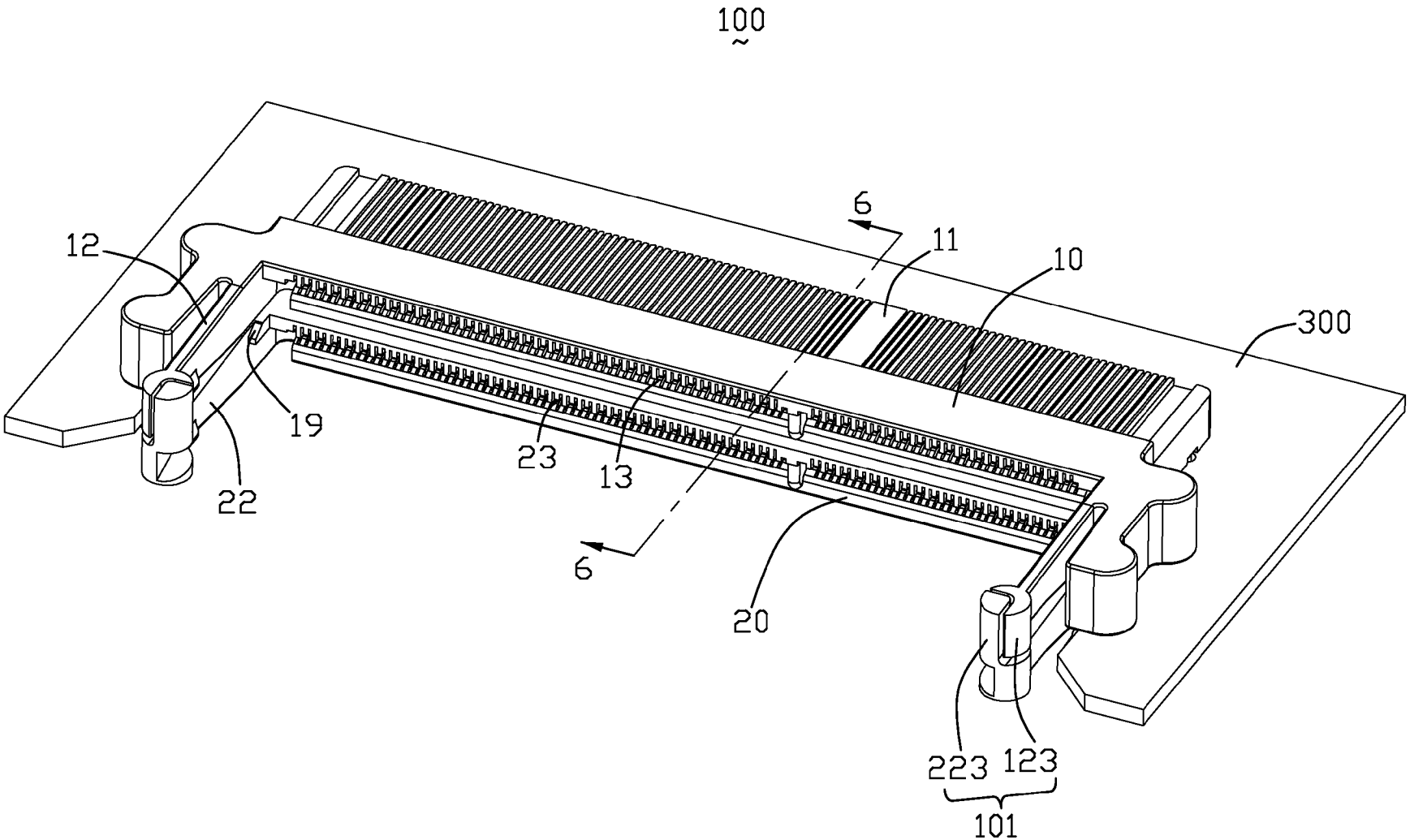
FIG. 1 is an assembled perspective view of an electrical connector assembly in accordance with a preferred embodiment of the present invention mounted on a PCB.

Reference will now be made to the drawing figures to describe a preferred embodiment of the present invention in detail.

Figure 6:
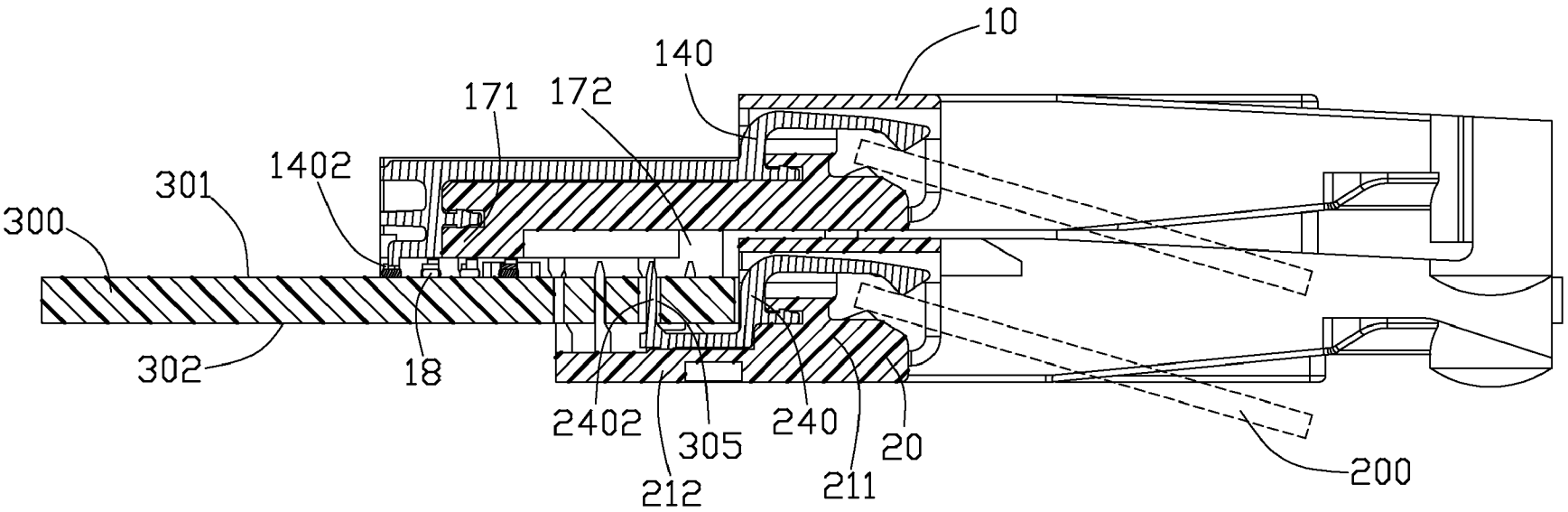
FIG. 6 is a cross-sectional view of the electrical connector assembly taken along line 6-6 of FIG. 1.

Referring to FIG. 1 and FIG. 6, an electrical connector assembly 100 of the present invention, for connecting memory modules 200 to a PCB 300 (Printed Circuit Board), mainly includes a first connector 10 mounted on a top/first surface 301 of the PCB 300 and a second connector 20 mounted on an opposite bottom/second surface 302 of the PCB 300.

Figure 2:
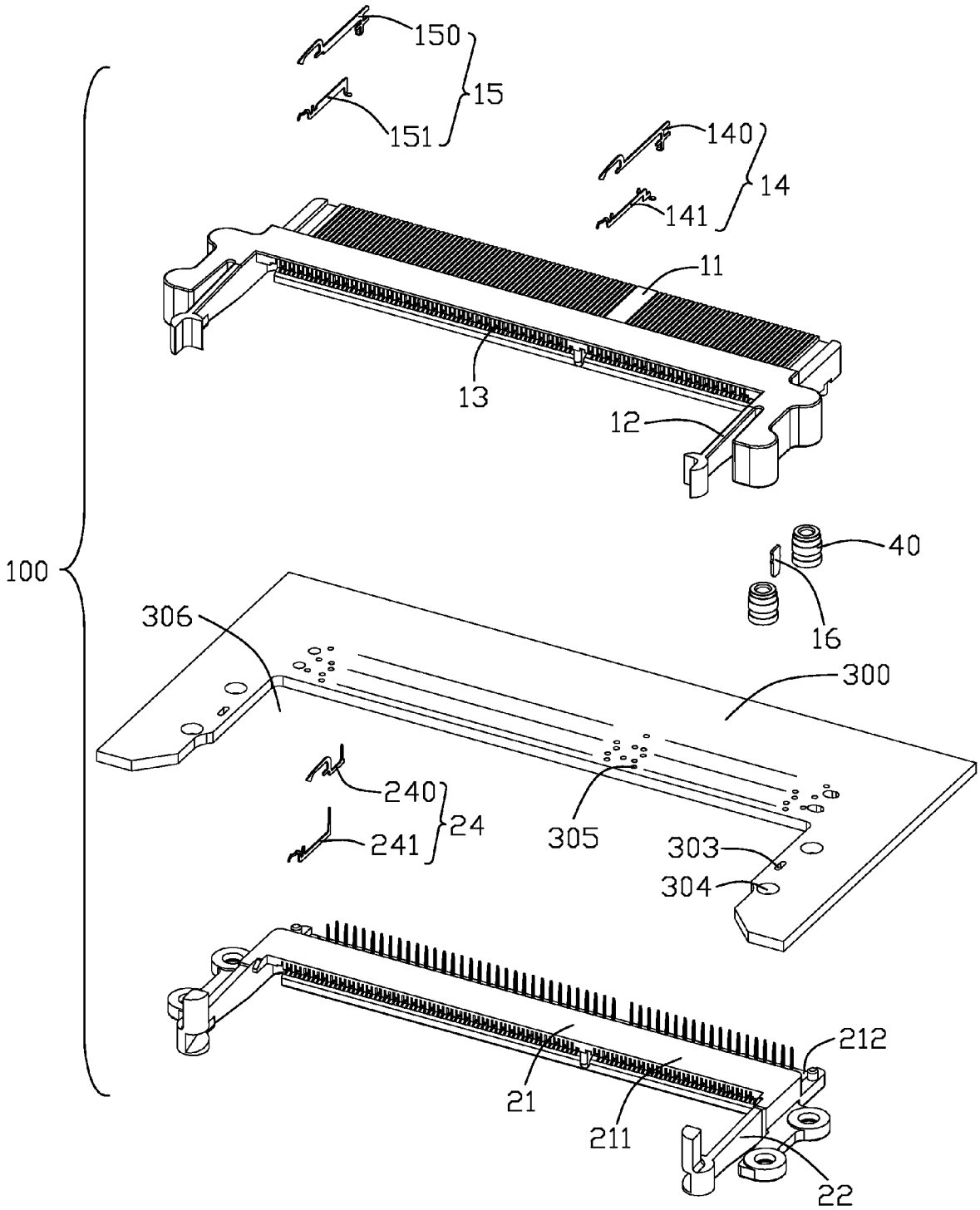
FIG. 2 is a partly exploded view of the electrical connector assembly shown in FIG. 1.
Figure 3:
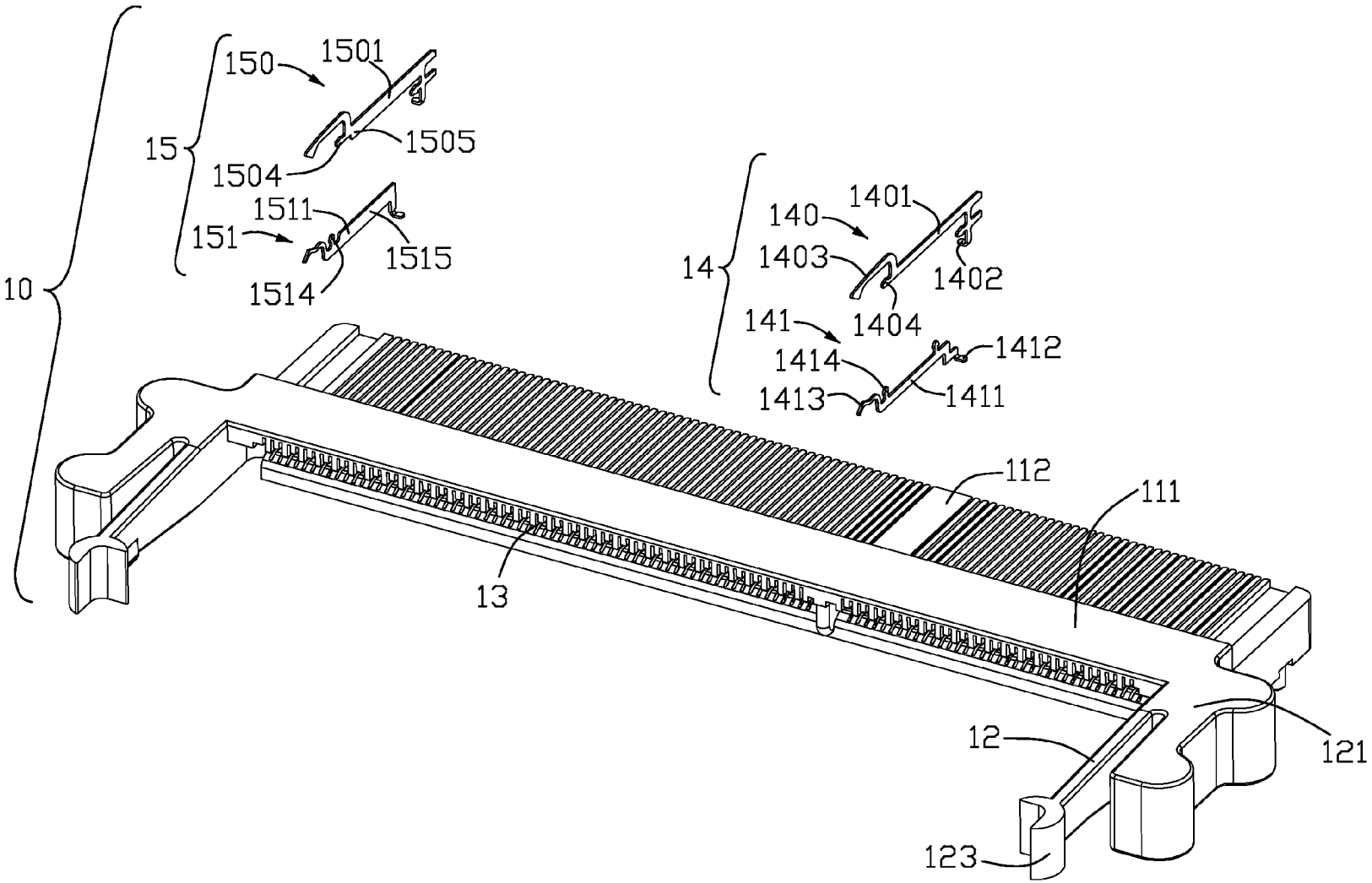
FIG. 3 is a partly exploded view of a first connector of the electrical connector assembly shown in FIG. 1.

Referring to FIG. 1 to FIG. 3, the first connector 10 includes a first insulative housing 11 and a plurality of first contacts received and retained in the first housing 11. The first housing 11 defines a longitudinal mating portion 111 with an inserted slot 13 extending along a longitudinal direction at a front face thereof for insertion of a connecting end of the memory module 200, and a pair of elastic latching arms 12 integrally extending forwards from two opposite ends of the mating portion 111. The latching arms 12 extend flatly and oppositely for restricting the memory module 200. The inserted slot 13 provides a plurality of passageways at opposite inner walls thereof for receiving the contacts. An extending portion 112 integrally extends from the mating portion 111. The extending portion 112 is lower than the mating portion 111 at a top face thereof and is at a similar lever with the mating portion 111 at bottom face 17 thereof (shown in FIG. 4). The extending portion 112 further defines a raised portion 171 extending downwards along edge side of the bottom face 17, therefore a cavity 172 is provided between the bottom face 17 and the raised portion 171 at a bottom portion of the first connector 10.

The first contacts include signal contacts 14 and grounding contacts 15. The signal contacts 14 define upper contacts 140 arranged in upper inner wall of the inserted groove 13 and lower contacts 141 arranged in lower inner wall thereof. Each of the upper/lower contacts 140/141 defines a base portion 1401/1411 retained in the extending portion 112, an elastic arm 1403/1413 extending forwards and upwards from the base portion 1401/1411 and partly projecting into the inserted groove 13, and a soldering leg 1402/1412 extending from a lower edge of the base portion thereof. The soldering legs 1402/1412 bend flatly to one side of the base portion and each retains a soldering ball 18 thereon for surface soldering. The grounding contacts 15 include first grounding contacts 150 arranged in the upper contacts 140 and second grounding contacts 151 arranged in the lower contacts 141. Each first grounding contact 150 is similar to an upper contact 140 except that the first grounding contact 150 defines an enlarged portion 1505 extending downwards and integrally from the base portion 1501, and the enlarged portion 1505 makes the base portion 1501 is larger than the base portion 1401. Each second grounding contact 151 is similar to a lower contact 141, and the second grounding contact 151 also defines an enlarged portion 1515 extending upwards and integrally from the base portion 1511. The upper contacts 140 and the first grounding contacts 150 are inserted into the housing 11 from a rear face, and the lower contacts 141 and the second grounding contacts 151 are inserted into the housing upwards from the bottom face 17, and all the first contacts are retained to the passageways by the retaining portions 1404, 1414, 1504, 1514 engaging with the housing. The soldering legs of the first contacts are mounted on the top surface 301 of the PCB 300 by SMT (Surface Mounted Technology).

The latching arms 12 each defines a post 123 projecting oppositely to each other from the distal end thereof. The housing 11 further defines a pair of blocking arms 121 respectively positioned outside of the latching arms 12, and each of the blocking arms 121 defines two retaining holes 122 opening downwards (shown in FIG. 5). A retaining member 16 engaging with a corresponding through hole 303 (shown in FIG. 2) is provided at the blocking arm 121 to retain the latching arm 12 to the PCB 300 steadily.

Figure 5:
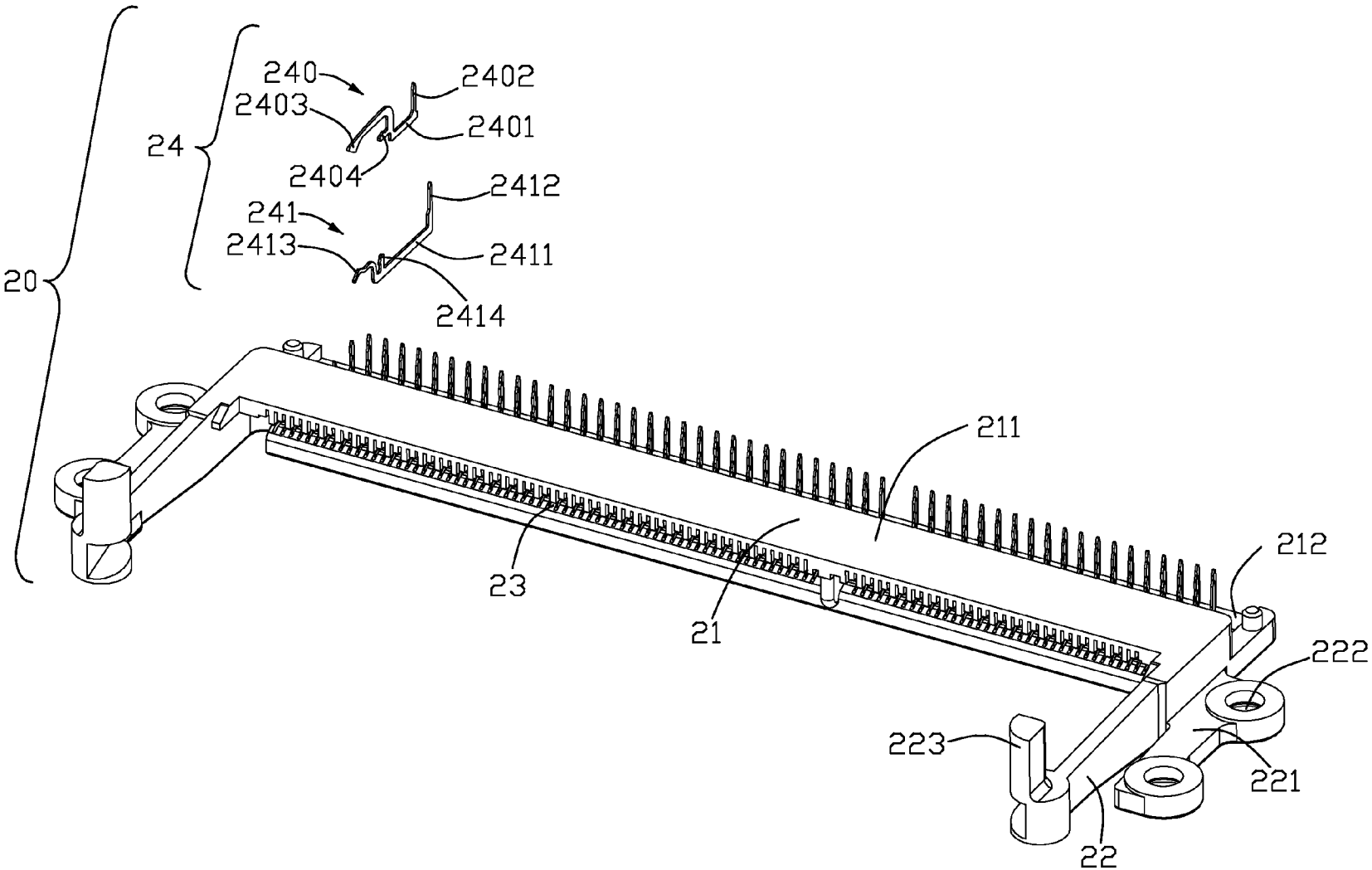
FIG. 5 is a partly exploded view of a second connector of the electrical connector assembly shown in FIG. 1.

Referring to FIG. 2 and FIG. 5, the second connector 20, having the similar configuration as the first connector 10, defines a second housing 21 and a plurality of second contacts 24 received and retained in the second housing 21. The second housing 21 defines a longitudinal mating portion 211 with an inserted slot 23 thereof, an extending portion 212 extending rearwards from the mating portion, a pair of elastic latching arms 22 and a pair of blocking portions 221 each positioned outside of the latching arm 22. The top face of the extending portion 212 is lower than that of the mating portion 211.

The second contacts 24 includes upper contacts 240 and lower contacts 241, and each of the upper/lower contacts 240/241 defines a base portion 2401/2411, an elastic arm 2403/2413 extending forwards from one end of the base portion 2401/2411 and partly projecting into the inserted slot 23, and a soldering leg 2402/2412 extending upwards from another end opposite to the elastic arm 2403/2413. The elastic arm 2403/2413 and the soldering leg 2402/2412 are positioned at a same side of the base portion 2401/2411. After the upper contacts 240 assembled to the second housing 21 from a rear face, and the lower contacts 241 assembled from a bottom face, the elastic arms 2403, 2413 extend into the inserted slot 23 and are retained in the mating portion 211 by the retaining portions 2404, 2414 engaging with the second housing, and the base portions 2401, 2411 are received in the extending portion 212 and the soldering legs 2402, 2412 extend upwards and project out of the extending portion 212. The second connector 20 also can provide contacts with enlarged base portion arranging in upper and lower contacts 240, 241 for improving the capability of the second connector 20.

The second connector 20 is upwards mounted on the PCB 300 having a gap 306 at an edge thereof, and the mating portion 211 is received in the gap 306 with partly passing through the gap 306 and projecting beyond the top surface 301 (shown in FIG. 6), and the lower extending portion 212 is positioned under the bottom surface 302. The vertical soldering legs 2402, 2412 run through the corresponding soldering holes 305 running through the opposite top and bottom surfaces 301, 302 of the PCB 300. The second connector 20 is vertically located below the PCB 300 and upwardly mounted on the bottom surface 302 of the PCB 300, which will decrease the height of the connector assembly 100. The blocking portions 221 are positioned under the PCB 300 and abut against the bottom surface 302, and the retaining holes 222 provided in the blocking portion 221 align with the corresponding through holes 304 provided beside the gap 306.

Figure 4:
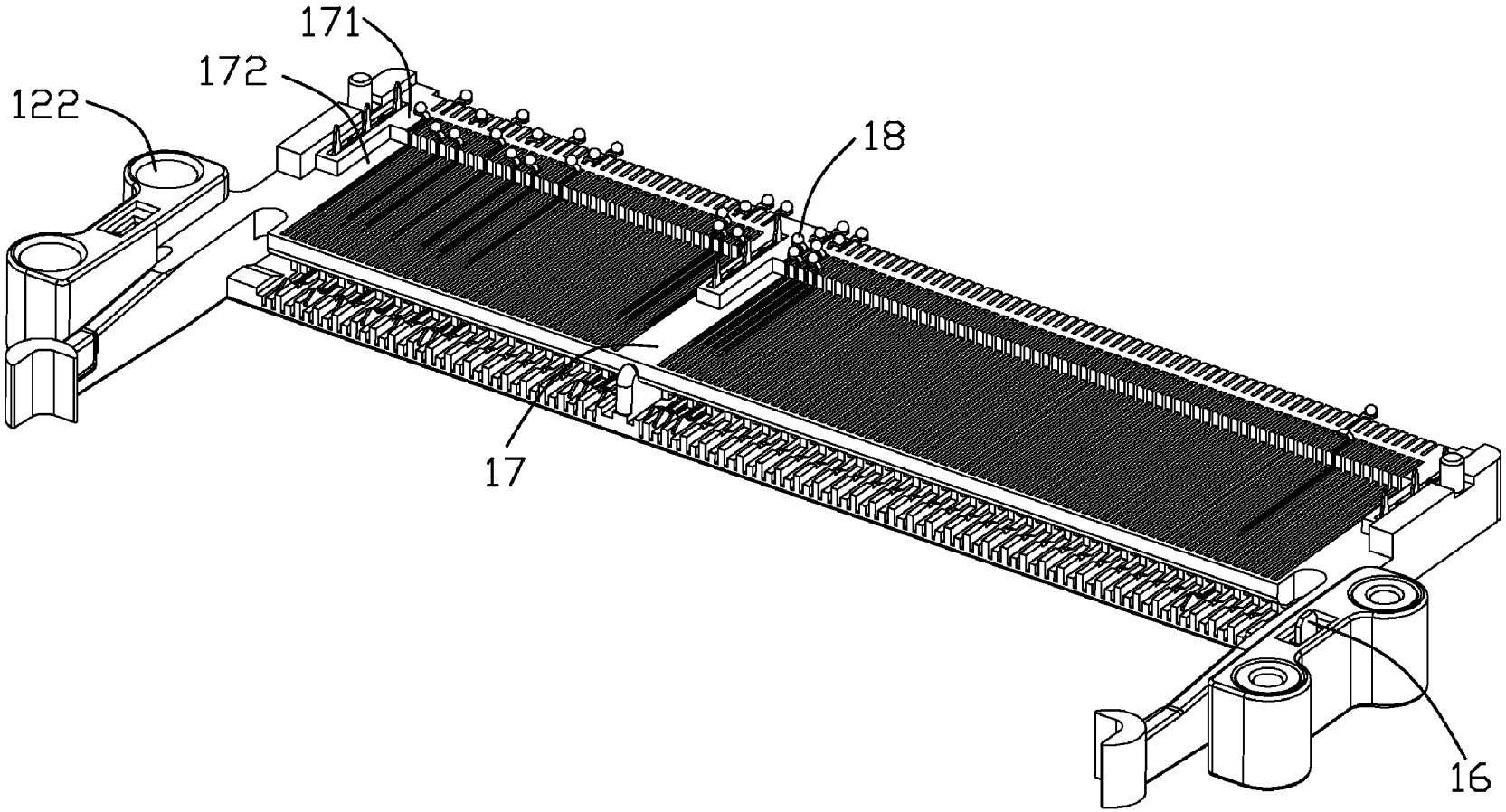
FIG. 4 is a perspective view of the first connector.

Referring to FIG. 2, FIG. 4 and FIG. 6, the first connector 10 is mounted on the PCB 300 from a top-to-bottom direction with the raised portion 171 and the blocking arms 121 attaching to the top surface 301, and the cavity 172 is over the soldering holes 305 of the second connector 20. The soldering legs of the first contacts 14, 15 are positioned behind the vertical soldering legs 2402, 2412 and disposed in different rows along the longitudinal direction. The vertical soldering legs 2402, 2412 run through the PCB 300 and enter into the cavity 172. The retaining holes 122 align with the through holes 304, and a pair of fixing portions 40 run through the aligned retaining holes 122, 222 and the through holes 304 to retain the first and second connectors 10, 20 to the PCB 300 steadily. The first and second connectors 10, 20 are positioned at two opposite sides of the PCB 300, and the front face of the first connector and the front face of the second connectors are disposed in a same plane vertical to the PCB 300. The post 123 cooperate with the corresponding projecting portion 223 disposed at a free end of the latching arm 22 and extending upwards to provide an operating portion 101, and push the operating portion 101 outwards, the memory modules 200 retained in the first and second connectors 10, 20 will be released synchronously. A supporting portion 19 provided at an inner face of each latching arm 22 may support the memory module 200 connected with the first connector 10 to prevent the memory module 200 from falling downwards. Each of the first connector 10 and the second connector 20 is configured to allow a corresponding memory module to be initially inserted into the corresponding slot in a slanted direction and successively rotated to a final horizontal position along a rotation direction from the second surface to the first surface.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for connecting memory modules to a printed circuit board (PCB), comprising:

a first connector mounted on a top surface of the PCB, including a first insulative housing and a plurality of first contacts received and retained in the first housing, and the first housing defining a front face and an inserted slot for receiving the memory module running through the front face along a longitudinal direction, and each of the first contacts defining an elastic arm partly projecting into the inserted slot and a soldering leg connecting to the PCB; and a second connector mounted on a bottom surface of the PCB, including a second insulative housing and a plurality of second contacts received and retained in the second housing, and the second housing defining a front face and an inserted slot for receiving the memory module running through the front face along a longitudinal direction, and each of the second contacts defining an elastic arm partly projecting into the inserted slot and a soldering leg connecting to the PCB;

wherein the first housing defines a raised portion projecting downwards from a bottom face thereof, thereby providing a cavity at a bottom portion of the first connector, and a part of the second housing projects beyond the top surface of the PCB, and the soldering legs of the second connector run through the opposite top and bottom surfaces of the PCB and enter into the cavity.

2. The electrical connector assembly as described in claim 1, wherein the front face of the first connector and the front face of the second connectors are disposed in a same plane vertical to the PCB.

3. The electrical connector assembly as described in claim 1, wherein the second housing defines a mating portion for receiving the elastic arms of the second contacts, and an extending portion extending rearwards from the mating portion, and an upper portion of the mating portion projects beyond the top surface of the PCB, and the extending portion is under the PCB.

4. The electrical connector assembly as described in claim 1, wherein the soldering legs of the first connector are positioned behind the soldering legs of the second connector.

5. The electrical connector assembly as described in claim 1, wherein the soldering legs of the first connector are soldered on the top surface of the PCB by Surface Mounted Technology, and the soldering legs of the second connector are soldered into corresponding soldering holes running through the PCB.

6. The electrical connector assembly as described in claim 1, wherein each of the first contacts defines a base portion, and the elastic arm of each first contact extends forwards and upwards from a front end of the base portion and the soldering leg extends downwards from a lower edge of the base portion and bends parallel to the PCB.

7. The electrical connector assembly as described in claim 1, wherein each of the second contacts defines a base portion, and the elastic arm of each second contact extends forwards and upwards from a front end of the base portion and the soldering leg extends upwards from an opposite end of the base portion, and the elastic arm and soldering leg of each second contact are disposed at a same side of the base portion.

8. The electrical connector assembly as described in claim 1, wherein the first contacts define at least one grounding contact having a base portion, and the at least one grounding contact defines an enlarged portion extending integrally from the base portion.

9. An electrical connector assembly mounted on a PCB, comprising:

a first connector mounted on a top surface of the PCB, including a first insulative housing having an inserted slot running through a front face thereof along a longitudinal direction and a plurality of first contacts received and retained in the first housing, each of the first contacts having a soldering leg connected to the PCB; and a second connector mounted on a bottom surface of the PCB, including a second insulative housing having an inserted slot running through a front face thereof along a longitudinal direction and a plurality of second contacts received and retained in the second housing, each of the second contacts having a soldering leg connected to the PCB;

wherein a part of the second housing projects beyond the top surface of the PCB, and all the soldering legs of the first connector are disposed behind the soldering legs of the second connector.

10. The electrical connector assembly as described in claim 9, wherein the soldering legs of the first connector are soldered on the top surface of the PCB by SMT (surface mounted technology), and the soldering legs of the second connector are soldered into corresponding soldering holes running through the top and bottom surfaces of the PCB.

11. The electrical connector assembly as described in claim 10, wherein the first housing defines a raised portion projecting downwards from a bottom face thereof for providing a cavity at a bottom portion of the first connector, and the soldering legs of the second connector run through the soldering holes and enter into the cavity.

12. The electrical connector assembly as described in claim 11, wherein the second housing defines a mating portion for receiving the elastic arms of the second contacts, and an extending portion extending rearwards from the mating portion, and an upper portion of the mating portion projects beyond the top surface of the PCB, and the extending portion is under the PCB.

13. An electrical connector assembly comprising:

a printed circuit board defining opposite first and second surfaces thereof and a cutout along a front edge region thereof;

a first connector including a first insulative housing defining a first elongated main body with a first inserted slot extending along a longitudinal direction thereof;

a plurality of first contacts disposed in the first main body under condition that said first connector is essentially positioned beside the first surface;

a second connector including a second insulative housing defining a second elongated main body with a second inserted slot extending along said longitudinal direction; and a plurality of second contacts disposed in the second main body under condition that the second main body of the second connector is essentially positioned in the cutout while a rear portion of the second connector behind the second main body being positioned beside the second surface; wherein the first main body and the second main body are aligned with each other in a direction perpendicular to said printed circuit board, tails of the second contacts extend from the second surface, through the printed circuit board, to the first surface with tips of said tails extending beyond the first surface and disposed in the space formed between the first connector and the printed circuit board.

14. The electrical connector assembly as claimed in claim 13, wherein said second connector is essentially closer to the printed circuit board than the first connector in said vertical direction.

15. The electrical connector assembly as claimed in claim 13, wherein tails of the first contacts are located behind the tails of the second contacts.

16. The electrical connector assembly as claimed in claim 13, wherein each of said first connector and said second connector is further equipped with a pair of retaining latches located in front of the corresponding main body and in the cutout for holding a corresponding memory module received in the cutout with a corresponding mating edge received in the corresponding slot.

17. The electrical connector assembly as claimed in claim 16, wherein each of the first connector and the second connector is further equipped with a pair of side arms outwardly beside the corresponding retaining latches, respectively, for securing the corresponding connector to the printed circuit board.

18. The electrical connector assembly as claimed in claim 17, wherein said pair of retaining latches of the first connector and that of the second connector essentially intimately confront each other in the vertical direction while said pair of side arms of the first connector and that of the second connector essentially seated upon the corresponding first surface and second surface, respectively.

19. The electrical connector assembly as claimed in claim 18, wherein a fastening pole extends though the corresponding side arm of the first connector and the printed circuit board and the correspond side arm of the second connector to fasten all together.

20. The electrical connector assembly as claimed in claim 13, wherein each of the first connector and the second connector is configured to allow a corresponding memory module to be initially inserted into the corresponding slot in a slanted direction and successively rotated to a final horizontal position along a rotation direction from the second surface to the first surface.

* * * * *